US005233976A

United States Patent [19]

Ferguson

[11] Patent Number: 5,233,976

[45] Date of Patent: Aug. 10, 1993

[54] SECOND STAGE REGULATOR HOSE WITH BUILT-IN CONE ADJUSTING TOOL

[75] Inventor: Arthur R. Ferguson, Northbrook, Ill.

[73] Assignee: Dacor Corporation, Northfield, Ill.

[21] Appl. No.: 874,739

[22] Filed: Apr. 27, 1992

[51] Int. Cl.[5] ..... A62B 7/04

[52] U.S. Cl. ..... 128/204.26; 128/205.24; 128/200.24; 137/327; 137/908; 291/360

[58] Field of Search ..... 137/327, 908; 251/360, 251/363; 7/165; 81/436, 451, 458, 461, 457; 128/200.24, 204.26, 205.24, 207.12

[56] References Cited

U.S. PATENT DOCUMENTS

| | | | |
|---|---|---|---|
| 1,946,239 | 2/1934 | Ryan | 81/436 |
| 2,592,978 | 4/1952 | Trimboli | 81/436 X |
| 2,728,340 | 12/1955 | Meidenbauer, Jr. | 128/204.26 |
| 2,923,335 | 2/1960 | Joyce | 81/436 X |
| 3,288,002 | 11/1966 | Mankovitz | 81/436 |
| 3,783,891 | 1/1974 | Christianson | 137/491 |
| 4,041,977 | 8/1977 | Matsuno | 137/494 |
| 4,041,978 | 8/1977 | Leemann | 137/494 |
| 4,140,112 | 2/1979 | Kobzan | 128/204.25 |
| 4,214,580 | 7/1980 | Pedersen | 128/204.26 |
| 4,267,858 | 5/1981 | Lewis | 137/327 X |
| 4,354,520 | 10/1982 | Easley, Jr. | 137/908 X |
| 4,356,820 | 11/1982 | Trinkwalder | 128/204.26 |
| 4,503,852 | 3/1985 | Christianson | 128/204.26 |
| 4,616,645 | 10/1986 | Pedersen et al. | 128/204.26 |
| 4,798,202 | 1/1989 | Chambonnet | 128/204.26 |
| 4,862,884 | 9/1989 | Christianson | 128/204.26 |
| 5,035,238 | 7/1991 | Christianson | 128/204.26 |
| 5,042,473 | 8/1991 | Lewis | 128/205.24 |
| 5,107,882 | 4/1992 | Carroll | 137/327 |

FOREIGN PATENT DOCUMENTS

| | | | |
|---|---|---|---|
| 709960 | 8/1941 | Fed. Rep. of Germany | 137/908 |
| 1027516 | 6/1956 | Fed. Rep. of Germany | 137/908 |
| 1185065 | 1/1957 | Fed. Rep. of Germany | 137/908 |
| 1252462 | 12/1960 | France | 137/908 |
| 910548 | 11/1962 | United Kingdom | 137/908 |
| 1401613 | 7/1975 | United Kingdom | 137/908 |

*Primary Examiner*—Edgar S. Burr
*Assistant Examiner*—Eric P. Raciti
*Attorney, Agent, or Firm*—Welsh & Katz, Ltd.

[57] ABSTRACT

A built-in regulator cone adjusting tool for a second stage regulator having a housing, an inlet port in the housing, and a cone having a front end and being disposed in the inlet port for reciprocal axial movement, the tool including a tubular body configured for axial rotation in the inlet port of the housing and having a first end and a second end, the second end having at least one tab for releasably engaging the front end of the cone for adjusting the relative position of the cone in the housing.

15 Claims, 1 Drawing Sheet

SECOND STAGE REGULATOR HOSE WITH BUILT-IN CONE ADJUSTING TOOL

BACKGROUND OF THE INVENTION

The present application relates to second stage breathing regulators used for scuba diving, and specifically to an adjusting tool for use with such regulators having an adjusting cone or valve seat.

In conventional second stage regulators, in which the quantity of pressurized air or other gas or gaseous mixtures supplied to the user is determined by the breathing demands of the user and is adjustable by the user during such use, a lever is provided for operating the valve seat in response to movement of a diaphragm. The diaphragm in turn deflects due to changes in pressure induced by the diver's breathing. The relative position of the lever in the regulator housing is set during manufacture by adjustment of the valve seat, also known as the regulator cone. In many cases, the cone is a small piece threaded inside the regulator for purposes of miniaturization. For such regulators, a special tool must be used during assembly to properly adjust the cone position under pressure. The conventional tool must be connected between the pressurized air delivery conduit and the regulator housing to adjust the lever position while the regulator is under pressure. Upon completion of the adjustment, the tool is removed and the conduit is reconnected to the regulator housing.

One disadvantage of conventional second stage regulators is that the regulator housing is plastic, and as such is subject to subtle variations and deformation each time it is disassembled. Thus, the act of inserting and removing the conventional adjusting tool may potentially introduce a flaw into the assembled regulator which may impair its performance.

Another disadvantage of conventional regulator cone adjusting tools is that the reconnection of the air supply conduit to the regulator housing may alter the previously adjusted position of the regulator cone.

A further disadvantage of conventional regulator cone adjusting tools is that the operation of adjusting the cone using the conventional tool system involves significant manufacturing assembly time.

Thus, it is an object of the present invention to provide an apparatus for adjusting the regulator cone which does not require supplemental tools.

It is also an object of the present invention to provide an apparatus for adjusting the regulator cone which does not subject the regulator housing to unnecessary deformation.

It is another object of the present invention to provide a regulator cone adjusting apparatus which is built-in to both the regulator hose and the regulator.

It is still another object of the present invention to provide a regulator cone adjusting apparatus which positively adjusts the position of the regulator cone to prevent unwanted movement of the cone upon reconnection of the air supply hose to the regulator housing.

SUMMARY OF THE INVENTION

Accordingly, the objects of the invention are achieved or exceeded by providing a built-in regulator cone adjusting tool for a second stage regulator having a housing, an inlet port in the housing, and a cone having a front end and being disposed in the inlet port for reciprocal linear movement, wherein the tool is a part of the completed regulator. During assembly, the tool is moved in an axial direction within the inlet port of the regulator to engage and adjust the position of the cone relative to the housing. After adjustment, the tool is disengaged from the cone and releasably locked in position relative to the housing to serve as the connection point for the air supply hose.

More specifically, the present built-in regulator cone adjusting tool includes a tubular body configured for axial rotation in the inlet port of the housing and has a first end and a second end, the second end having at least one tab for releasably engaging the front end of the cone for adjusting the relative position of the cone in the housing. Upon the adjustment of the core, the tool is configured to remain connected to the housing.

The present invention also includes an air supply conduit or hose for use with a second stage diving regulator having a housing with an inlet port, a cone having a front end and being disposed in the inlet port for reciprocal linear movement, a length of flexible hose having an open end, a regulator cone adjusting tool having a tubular body configured for axial rotation in the inlet port of said housing and having a first end configured for connection to the open end of the flexible hose, a second end, and a central portion. The second end has a formation for releasably engaging the front end of the cone for adjusting the relative position of the cone in the housing.

DESCRIPTION OF THE PREFERRED EMBODIMENT

Figure 1:
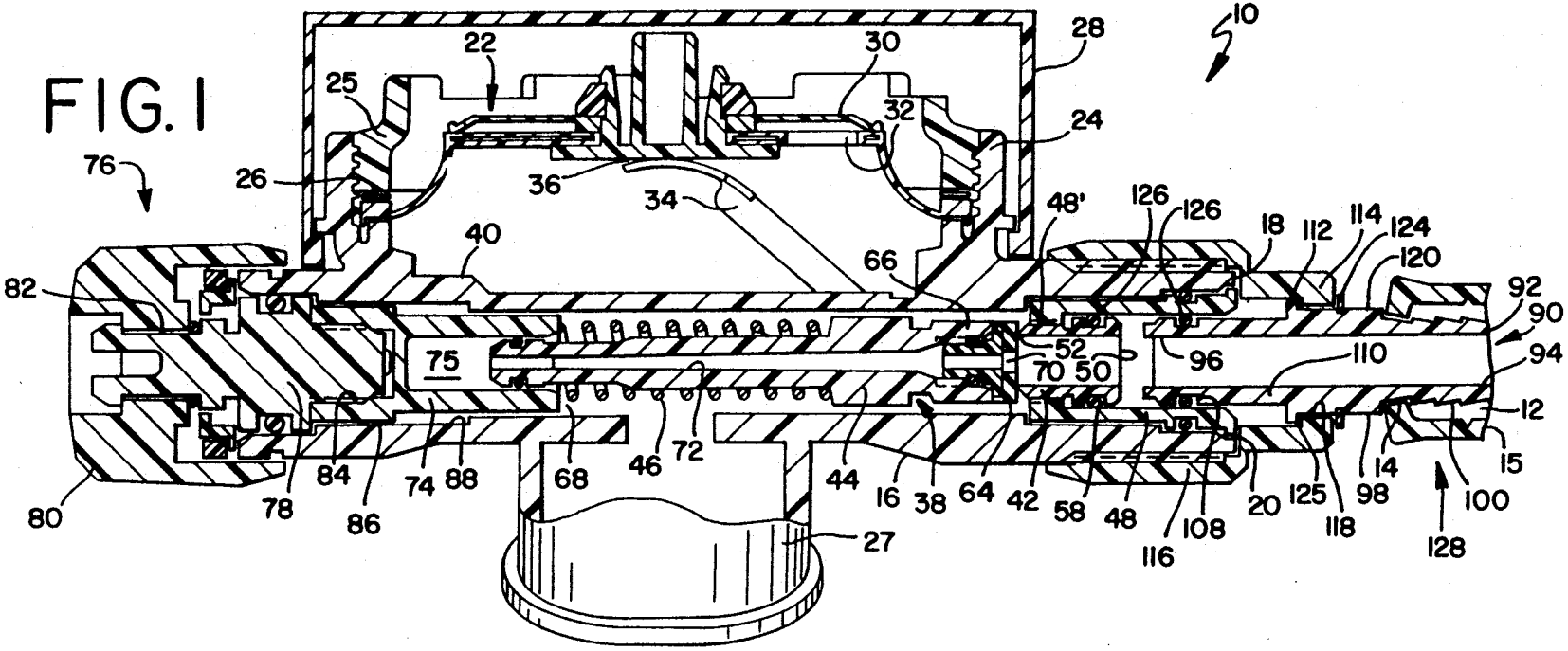
FIG. 1 is a vertical sectional elevational view of a second stage regulator of the type suitable for use with the present built-in cone adjusting tool.

Referring now to the drawing, and in particular to FIG. 1, there is shown a regulator generally designated 10. A typical regulator suitable for use with the present invention is described in commonly-assigned U.S. Pat. No. 4,616,645, which is incorporated by reference herein. In a demand breathing system, regulator 10 is pneumatically coupled with a tank (not shown) of air or other breathable gaseous mixture (hereafter referred to as "air" for brevity) under pressure through a first valve (not shown) usually mounted on the tank. Air from the tank and first valve is conveyed to regulator 10 by means of a conduit 12, which can be a flexible tube or hose, having an open free end 14. A crimpable hose clamp fitting 15 is normally used to secure the conduit 12 to the regulator 10. In the preferred embodiment, the fitting 15 is metallic, although the use of other suitable crimpable materials is contemplated.

Regulator 10 includes a regulator housing 16, which in the preferred embodiment is made of a rigid plastic or other noncorrosive material, and which includes an inlet port 18 having an open end 20. A diaphragm assembly, generally indicated at 22, is mounted in a diaphragm housing portion 24 of the regulator housing 16 and is secured therein by a diaphragm retainer 25 and a washer 26 in a manner which permits the diaphragm assembly 22 to deflect in response to changes in air pressure on the air inlet side of the diaphragm, i.e., the side facing a mouthpiece tube 27, which lies opposite the diaphragm on the housing 16.

Diaphragm assembly 22 and housing 24 are enclosed by a removable cover 28, with openings (not shown) to permit exhausted air to escape from regulator 10, and to permit water to enter for exerting pressure on the opposite side of the diaphragm. The cover 28 is preferably flexible.

The diaphragm assembly 22 can also include an exhaust valve 30 which can be deflected by air pressure on the air inlet side of the diaphragm after deflection of the diaphragm away from mouthpiece tube 27 to the fullest extent. Diaphragm assembly 22 can also include an exit port 32 to permit the air on the inlet side of diaphragm 18 to pass therethrough to exert pressure on the diaphragm cover 28.

The regulator 10 further includes a lever 34 which has one end position 36 normally abutting a portion of diaphragm assembly 22 so that the lever moves in response to the movement of the diaphragm. Regulator 10 includes air inlet valve 38 which desirably is aligned and coupled with conduit 12 within a valve housing 40. The end of the housing 40 adjacent conduit 12 supports a valve seat or cone 42 against which a valve stem 44 is normally held by means of a biasing spring 46, and is movable within housing 40 away from cone 42 against the force of spring 46. The position of the cone 42 relative to the regulator housing 16 is maintained by a tubular cone adaptor or retainer 48 having a threaded portion 48'.

Figure 3:
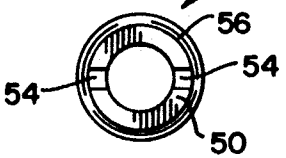
FIG. 3 is a front elevational view of the cone shown in FIG. 2.
Figure 2:
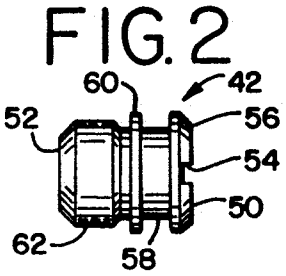
FIG. 2 is a side elevational view of the regulator cone or valve seat shown in the regulator of FIG. 1.

Referring now to FIGS. 1-3, the cone 42 is substantially tubular in shape and includes a front end 50 and a rear end 52. The front end 50 has a generally flattened end surface with at least one slot 54 cut therein. In the preferred embodiment, two slots 54 are provided disposed diametrically upon the front end 50. An outer peripheral edge 56 of the front end 50 is beveled.

An annular O-ring groove 58 is located adjacent the front end 50 and extends approximately half the axial length of the cone 42. The groove 58 is defined at one end by the peripheral edge 56 of the front end 50 and at the other by a radially projecting annular ring 60. The peripheral edge 56 and the annular ring 60 have approximately the same diameter. A threaded portion 62 of the cone 42 is located between the annular ring 60 and the second end 52, and is dimensioned to be threadably engaged in an end of the cone retainer 48 opposite the open end 20. The second end 52 of the cone 42 is beveled to provide a positive airtight seal against a resilient gasket or molded seat 64 located on the cone end 66 of the valve stem 44.

The cone 42 and the cone retainer 48 are preferably formed of metal so that these parts, which receive relatively high pressure air from the conduit 12, will withstand that pressure without deforming as might occur if the parts were of plastic. In this manner, the housing 40, being of rigid plastic, is not subjected to the relatively high pressure air from conduit 12.

Valve stem 44 is connected to the lever 34 so that deflection of diaphragm assembly 22 toward the mouthpiece tube 27 will cause the lever to deflect and move the valve stem 44 away from the cone 42. Subsequent deflection of the diaphragm assembly 22 in the opposite direction will allow the lever 34 to return to its normal position, allowing the valve stem 44 to return to its normal position against the cone 42. As is known in the art, adjustment of the cone 42 relative to the cone retainer 48 will alter the "at rest" position of the stem 44, thus adjusting the position of the lever 34.

As described previously, the cone 42 is secured to the retainer 48 by relatively fine screw threads 48' and 62, whereby advancing or retracting the cone with respect to the retainer will initially position or set the valve stem 44 to position the lever 34 at the point within housing 16 at which lever 34 engages diaphragm assembly 22. The threaded engagement of the cone 42 within the retainer 48 also facilitates the removal of the cone 42 for servicing or replacement due to wear.

When the valve stem 44 is moved away from cone 42 through movement of the lever 34, air from conduit 12 passes between the cone and the cone end 66 of the stem 44 into a cavity 68 formed by the valve housing 40. A central bore 70 in the gasket 64 provides a passageway through which a portion of the stream of air from conduit 12 may pass. The remainder of stem 44 also includes a central bore 72 through which the stream of air flowing through the bore 70 in the gasket 64 may pass.

The end portion of the stem 44 opposite the gasket 64 is retained for axial movement within a balance chamber 74. The chamber 74 also retains and exerts pressure on the biasing spring 46, and defines a socket 75 which receives the stream of air flowing through the bore 72.

The regulator 10 includes an adjusting mechanism for axially moving the balance chamber 74 toward and away from the cone 42 to provide for adjustment of the tension of the biasing spring 46 by the user while using the regulator. As shown, the adjusting mechanism, generally designated 76, includes a non-metallic shaft 78 rotatably supported within the housing 40 and extending therefrom, and a non-metallic knob 80 mounted to the portion shaft 78 extending externally from the housing 40.

The knob 80 is secured to the shaft 78 for rotation therewith by means of splines 82 on the shaft which engage mating splines on the knob. The opposite end portion of shaft 78 is threaded and mates with internal threads 84 formed on the end portion of the balance chamber 74. Knob 80 is mounted so that is it not freely rotatable nor extends from a thin shaft, and thereby cannot be readily accidently rotated or caught on structures which may otherwise occur.

Upon purposeful adjustment of knob 80 by the user, the shaft 78 rotates within the housing 40, but does not move axially. Instead, the balance chamber 74, through its threaded engagement with the shaft 78, moves axially within the inside of the valve housing 40 to adjust tension on the spring 46. In the preferred embodiment, the balance chamber 74 is provided with splines 86 which are engaged in a track 88 formed in the housing 40.

If rotation of the knob 80 is attempted to advance the balance chamber 74 toward the cone 42 beyond the limits of threads 84, the threads will eventually disengage, and the chamber will not advance further, as spring 46 will hold the chamber 74 against the end of shaft 78. Upon subsequent adjustment in the opposite direction, the threads will reengage due to the action on the chamber 74 of the spring 46.

Overadjustment by the user which would fully retract the chamber 74 away from the spring 46 and stem 44 is prevented, since full retraction of the chamber would open the valve 38, permitting the free flow of air from conduit 12 to mouthpiece tube 27 and thus alerting the user to this condition. Thus, by rotation of the knob 80, the tension on biasing spring 46 can be selectively increased or decreased, thereby adjusting the balancing of valve stem 44 between chamber 74 and the cone 42, and through the adjustment of the tension of biasing spring 46 restraining the opening of air inlet valve 38 when stem 44 is not in contact with cone 42. The adjusting mechanism provides for limiting the adjustment, while preventing its being damaged by attempted overadjustment.

Figure 5:
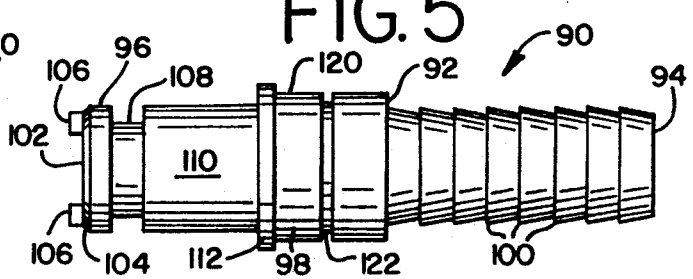
FIG. 5 is a side elevational view of the cone adjusting tool depicted in FIG. 4.
Figure 4:
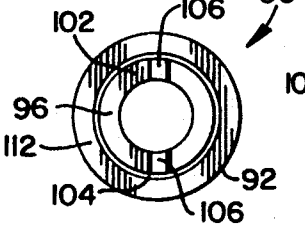
FIG. 4 is a rear elevational view of the present built-in cone adjusting tool.

Referring now to FIGS. 1, 4 and 5, the built-in cone adjusting tool of the invention is generally designated 90. The tool 90 may also be designated as a hose fitting, in that it is initially provided as a component of the air supply conduit 12. The tool 90 includes a tubular body 92 configured for axial movement and rotation in the inlet port 18 of the regulator housing 16. The body 92 has a first end 94, a second end 96, and a central portion 98 located between the first and second ends.

The first end 94 is configured with at least one and preferably several annular barb formations 100 located in linear alignment for achieving a positive connection with the open end 14 of the air conduit 12. To complete the air supply conduit assembly as provided to the regulator housing during assembly, the crimpable fitting 15 secures the tool 90 within the open end 14 of the conduit 12.

Opposite the first end 94, the second end 96 of the body 92 has a truncated, generally flattened surface 102 with a beveled peripheral edge 104. The second end 96 also includes at least one and preferably two axially projecting tabs 106 configured to matingly and releasably engage the slots 54 in the front end 50 of the cone 42.

Central portion 98 of the tubular body 92 includes an annular O-ring groove 108 located behind the peripheral edge 104 of the second end 96. A narrow shank portion 110 is located axially adjacent the O-ring groove 108 and has a diameter which permits sliding axial engagement within the cone retainer 48. The narrow shank portion 110 is defined by the O-ring groove 108 and a radially extending annular shoulder 112.

The shoulder 112 is configured to contact a thickened wall portion 114 of a hose assembly coupling 116 which is preferably metallic and is threadably engaged upon the end of the regulator housing 16 bearing the inlet port 18. The hose assembly coupling 116 is tubular in configuration and is dimensioned to slidably accommodate the tool 90 therein.

An opening 118 is defined by the thickened wall portion 114 and is dimensioned to slidingly accommodate a large diameter shank portion 120 of the tool's central portion 98. The large diameter shank portion 120 extends between the barbed formations 100 on the first end 94 and the shoulder 112 at the other end. An annular groove 122 is generally centrally disposed on the large diameter shank portion 120 and is configured to accommodate a spring biased retaining ring 124. If desired, an annular gasket or pad 125 may be attached to the first end side of the shoulder 112.

In the preferred embodiment, the large diameter shank portion 120 has a sufficient length to slidingly engage the opening 118 in the hose assembly coupling 116 as the tool 90 is moved in an axial direction into and out of engagement with the front end 50 of the cone 42. Furthermore, the annular groove 122 is spaced from the annular shoulder 112 a distance which approximately corresponds to the axial length of the thickened wall portion 114 of the hose assembly coupling 116. Thus, with the retaining ring 124 engaged in the groove 122, the tool 90 is restrained from significant axial movement through engagement of the shoulder 112 and the ring 124 against corresponding ends of the thickened wall portion 114.

In operation, and specifically during assembly, O-rings 126 are inserted into the respective O-ring grooves 58 on the cone 42, and 108 on the tool 90. The O-rings 126 prevent air from escaping from the cone retainer 48 and the hose assembly coupling 116, and allow the cone and the tool to be axially manipulated within the retainer 48 while maintaining a sealed environment. Due to the O-rings 126, the flow of air will be maintained through the tubular tool 90 and the cone 42. The cone 42 is threaded into the retainer 48 which is then inserted into the inlet port 18.

The air supply conduit 12, the hose clamp fitting 15, the tool 90 and the hose assembly coupling 116 are provided to the regulator 10 as an assembly designated 128. In the assembly 128, the tool 90 is inserted through the opening 118 in the hose assembly coupling 116 so that the shoulder 112 abuts the thickened wall portion 114 as shown in FIG. 1. The first end 94 of the tool is secured within the air supply conduit 12 by the fitting 15, and the coupling 116 axially swivels about the central portion 98 of the tool. The coupling 116 is threaded upon the regulator housing 16 so that the second end 96 of the tool matingly engages the inlet port 18 and the cone retainer 48. Air pressure is applied to the regulator 10 through the conduit 12 to adjust the core position.

To adjust the relative position of the cone 42 within the retainer 48, and thus adjust the base position of the lever 34, the cone must be axially rotated within the retainer. In order to accurately determine the position of the lever 34, the cover 28, diaphragm assembly 22, diaphragm retainer 25 and washer 26 are removed, making the lever visible. While conventional regulators require supplemental tools to complete this task, the present invention employs the built-in cone adjustment tool 90. The tool 90, accompanied by the conduit 12, is slid axially relative to the retainer 48 until the tabs 106 are inserted into, and matingly engage, the slots 54 in the front end 50 of the cone 42. In this respect, the tool is also a hose fitting since it also couples the conduit 12 with the regulator housing 16. The tool 90 and the regulator housing 16 are rotated relative to each other, either clockwise or counterclockwise, until the desired position of the cone 42 and the lever 34 is achieved. Ideally, the lever 34 should have only a slight amount of free play as it abuts the point 36.

Disengagement of the tool 90 from the cone 42 is easily accomplished by pulling the first end 94 away from the cone. The tool is locked into position relative to the hose assembly coupling 116 by bringing the annular shoulder 112 back into abutting relationship with the thickened wall portion 114, and placing the retaining ring 124 in the annular groove 122.

Thus, a major advantage of the present invention is the adjustment of the regulator cone 42 without supplemental or external tools which may disfigure or damage the regulator housing 16. In conventional regulators, the hose assembly coupling 116 must be connected and reconnected several times during the cone adjustment procedure, which exerts substantial stress on the plastic regulator housing 16. The housing 16 is thus subjected to potential deformation, and the adjusted position of the cone 42 and the cone retainer 48 may be affected.

Instead, the present built-in cone adjustment tool 90 is easily engaged and disengaged from the cone 42 to perform the adjustment procedure without removal of the coupling 116, after which time the tool remains connected to, and becomes a part of, the regulator. Should the cone 42 or other components of the regulator 10 require maintenance, the retaining ring 124 may be easily removed and the tool used to unscrew and remove the cone 42.

While a particular embodiment of the second stage regulator hose with built-in cone adjusting tool of the invention has been shown and described, it will be appreciated by those skilled in the art that changes and modifications may be made thereto without departing from the invention in its broader aspects and as set forth in the following claims.

What is claimed is:

1. An air supply conduit for use with a second stage regulator having a housing, an inlet port in the housing, and a cone having a front end and being disposed in the inlet port for reciprocal axial movement, said conduit comprising:

a length of flexible hose having an open end;

a regulator cone adjusting tool provided with a tubular body configured for axial movement and rotation relative to the inlet port of the housing and having a first end, a second end, and a central portion, said first end being configured for connection to said open end of said flexible hose, said second end having means for releasably engaging the front end of the cone for adjusting the relative position of the cone in the housing;

coupling means for releasably connecting said conduit to the regulator housing; and retention means for maintaining the relative position of said tubular body in relation to the inlet port.

2. The air supply conduit as defined in claim 1 wherein the front end of the cone has at least one slot, and said means for releasably engaging said second end of said tubular body includes at least one tab configured and arranged for insertion into the slot.

3. The air supply conduit as defined in claim 1 wherein said first end of said tool is fixed within an open end of said flexible hose, and, upon the adjustment of the cone, connects said hose with the inlet port of the regulator housing.

4. The air supply conduit as defined in claim 1 wherein said tool is provided with an annular groove, said retaining means includes a retaining ring configured to be seated within said annular groove, and a radially extending annular shoulder.

5. The air supply conduit as defined in claim 4 further including a hose assembly coupling for securing said tool and said hose to the regulator housing.

6. A second stage diving regulator, comprising:

a housing having an inlet port;

a cone having a front end and being disposed in the inlet port for reciprocal linear movement;

a cone adjusting tool having a tubular body configured for axial movement and rotation in said inlet port of said housing and having a first end, a second end, and a central portion;

said first end being connected to a flexible air supply conduit; and said second end having means for releasably engaging the front end of said cone for adjusting the relative position of said cone in said housing;

wherein upon the adjustment of the cone, said tool being configured to remain connected to the housing.

7. The regulator as defined in claim 6 wherein the front end of the cone has at least one slot, and said means for releasably engaging said second end of said tubular body includes at least one tab configured and arranged for insertion into the slot.

8. The regulator as defined in claim 6 wherein said first end of said tool is fixed within an open end of the air supply conduit, and, upon the adjustment of the cone, connects the conduit with said inlet port of said regulator housing.

9. The regulator as defined in claim 6 further including retaining means for maintaining the position of said tool relative to the inlet port.

10. The regulator as defined in claim 9 wherein said tool is provided with an annular groove, said retaining means includes a retaining ring configured to be seated within said annular groove.

11. A regulator cone adjusting tool for connection to a flexible air supply conduit for use with a second stage regulator, the conduit having a hose assembly coupler, the regulator having a housing, an inlet port in the housing, and a cone having a front end with at least one slot, the cone being disposed in the inlet port for reciprocal linear movement, said tool comprising:

a tubular body being in fluid communication with the inlet port and also being configured for axial movement and rotation relative to the inlet port of the housing, said body having a first end, a second end, and a central portion;

said first end is provided with at least one annular barb formation for connection to the flexible air supply conduit for introducing a flow of air into said body from said first end to said second end;

said second end having engaging means for releasably engaging the front end of said cone for adjusting the relative position of the cone in the housing, said engaging means including at least one tab configured and arranged for insertion into the at least one slot of the cone; and retaining means located on said central portion of said tool for maintaining the position of said tool relative to the inlet port, said retaining means including at least one radially projecting annular shoulder for engaging the coupler.

12. The adjusting tool as defined in claim 11 wherein said tool includes an annular groove on said central portion in axially spaced relationship to said annular shoulder to accommodate the coupler therebetween, and said retaining means further includes a retaining ring configured to be seated within said annular groove on said tool.

13. The adjusting tool as defined in claim 11 further including means for sealing said body in the inlet port of the regulator.

14. The adjusting tool as defined in claim 13 wherein said means for sealing includes at least one O-ring groove and an O-ring disposed therein.

15. The adjusting tool as defined in claim 14 wherein said O-ring groove and said O-ring are located adjacent said second end of said tool.

* * * * *